United States Patent [19]

Massey et al.

[11] 4,198,890

[45] Apr. 22, 1980

[54] KEYBOARD SYSTEM FOR MUSICAL INSTRUMENTS

[76] Inventors: Carman J. Massey, 1925 Father Ryan Dr., Biloxi, Miss. 39530; Paul N. Alito, 8321 Prichard Pl., New Orleans, La. 70118

[21] Appl. No.: 866,923

[22] Filed: Jan. 4, 1978

[51] Int. Cl.[2] ..... G10H 1/02; G10H 5/00

[52] U.S. Cl. ..... 84/1.01; 84/429; 84/445

[58] Field of Search ..... 84/1.01, 423–425, 84/429, 433, 445

[56] References Cited

U.S. PATENT DOCUMENTS

| | | | |
|---|---|---|---|
| 1,009,194 | 11/1911 | Smith | 84/423 |
| 2,542,532 | 2/1951 | Jewett et al. | 84/424 |
| 3,012,460 | 12/1961 | Wilson | 84/423 |
| 3,610,800 | 10/1971 | Deutsch | 84/1.01 |
| 4,048,893 | 9/1977 | Coles | 84/1.01 |
| 4,056,032 | 11/1977 | Coles | 84/1.01 |

*Primary Examiner*—S. J. Witkowski
*Attorney, Agent, or Firm*—Jacob Shuster

[57] ABSTRACT

Adjacent primary digitals of a musical keyboard are actuated in the same fingering sequence for all key signatures. Each primary digital forms part of a three section group having two secondary digitals for producing the sharps and flats. Through a separate selector keyboard, the tones produced by selected digitals are shifted by a half-tone in accordance with a logic applied program to transpose operation of the keyboard to the selected key signature.

10 Claims, 11 Drawing Figures

Fig. 10
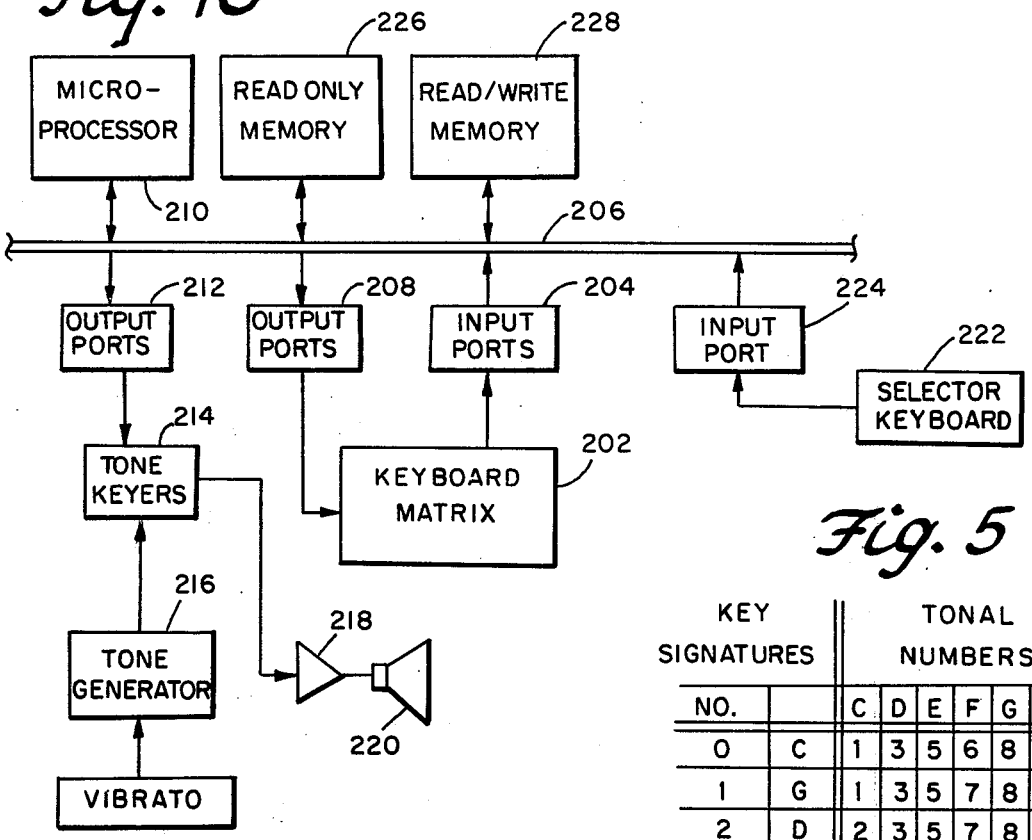
Fig. 5
| KEY SIGNATURES | | TONAL NUMBERS | | | | | | | |
|---|---|---|---|---|---|---|---|---|---|
| NO. | | C | D | E | F | G | A | B | C |
| 0 | C | 1 | 3 | 5 | 6 | 8 | 10 | 12 | 1 |
| 1 | G | 1 | 3 | 5 | 7 | 8 | 10 | 12 | 1 |
| 2 | D | 2 | 3 | 5 | 7 | 8 | 10 | 12 | 2 |
| 3 | A | 2 | 3 | 5 | 7 | 9 | 10 | 12 | 2 |
| 4 | E | 2 | 4 | 5 | 7 | 9 | 10 | 12 | 2 |
| 5 | B | 2 | 4 | 5 | 7 | 9 | 11 | 12 | 2 |
| 6 | F# | 2 | 4 | 6 | 7 | 9 | 11 | 12 | 2 |
| 7 | C# | 2 | 4 | 6 | 7 | 9 | 11 | 1 | 2 |
| 1 | F | 1 | 3 | 5 | 6 | 8 | 10 | 11 | 1 |
| 2 | B$^b$ | 1 | 3 | 4 | 6 | 8 | 10 | 11 | 1 |
| 3 | E$^b$ | 1 | 3 | 4 | 6 | 8 | 9 | 11 | 1 |
| 4 | A$^b$ | 1 | 2 | 4 | 6 | 8 | 9 | 11 | 1 |
| 5 | D$^b$ | 1 | 2 | 4 | 6 | 7 | 9 | 11 | 1 |
| 6 | G$^b$ | 12 | 2 | 4 | 6 | 7 | 9 | 11 | 12 |
| 7 | C$^b$ | 12 | 2 | 4 | 5 | 7 | 9 | 11 | 12 |
Fig. 11
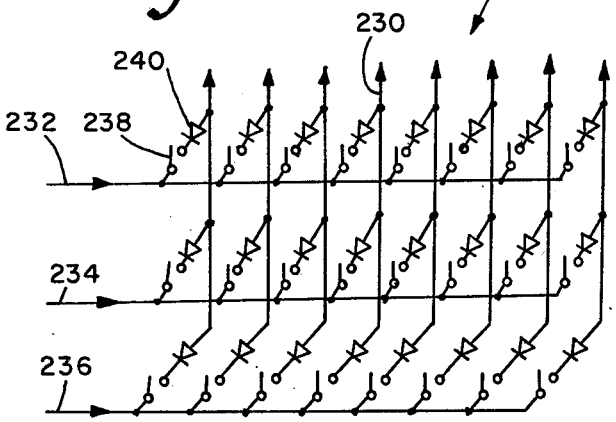

+6V
+5V
+5V
+5V
94
96
98
88
92
100
118
120
32
114
116
86
0
110
90
112
60
84
108
106
SHIFT
REGISTER
LOGIC
28
102
104
1#
56
2#
SELECTION
PATTERN
GENERATOR
54
52
50
70
30
A※
AL
AN
AR
82
2b
A#
76
TONE
KEYERS
68
72
64
74
1b
62
AN
18
66
5v
78
94
A#
Ab
58
16
AN
Ab
14
20
80

KEYBOARD SYSTEM FOR MUSICAL INSTRUMENTS

BACKGROUND OF THE INVENTION

This invention relates to musical keyboards and the transpositions involved in changing key signatures when playing a musical instrument through the keyboard.

Correlation of the arrangement of a standard musical keyboard with that of a standard musical staff is a problem confronting musicians and musical students for a long time as recognized, for example, in U.S. Pat. No. 1,009,194 to Smith. According to the Smith patent, this problem is dealt with by markings placed on the keys of a standard keyboard that is not otherwise altered. The correlation problem arises because of the provision of seven adjacent white digitals for each octave on the standard keyboard and five black digitals in groups of two and three to cover a total of 12 equitempered tones per octave. The fingering sequence applicable for playing different major scales therefore differ from each other and from the arrangement of musical notations on the musical staff from which instructions for fingering the keyboard is derived. As outlined in U.S. Pat. No. 4,048,893 to Coles, various methods have been proposed for alleviating the difficulties incident to the different fingering sequence called for by the key signatures noted on written music. In all of the prior art teachings referred to including the Coles patent itself, the basic standard keyboard arrangement is retained. Only key switching and pitch changing systems are relied upon to modify keyboard operation in an attempt to reduce the fingering sequence learning problem.

It is therefore an important object of the present invention to provide a new keyboard arrangement compatible with the fingering experience acquired by playing of standard keyboards, which more closely corresponds graphically to the arrangement of a musical staff.

A further object is to provide in association with the new keyboard, a system for selecting key signatures without requiring any change in fingering sequence.

Yet another important object is to provide a player keyboard which will offer new and expanded options for fingering chords and passages while still retaining all of the fingering patterns to which use of a standard keyboard is limited in accordance with musical theory principles well known in the art.

SUMMARY OF THE INVENTION

In accordance with the present invention a new player keyboard is provided wherein the same fingering sequence characterizing the playing of the major C scale on a standard keyboard, is utilized for playing in any key signature. The player keyboard includes adjacent key groups forming a horizontal bank of primary digitals corresponding to the naturals or white keys of a standard keyboard for playing in the key of C. Each key group is split into secondary digitals on either side of the primary digital closer to and further from the player for producing a sharp and flat of the tone produced by actuation of the intermediate primary digital. All digitals of the keyboard have a common finger contact surface which may be planar or curved to accommodate player convenience. Transposition to a selected key signature may be effected through a separate selector keyboard although transposition may also be effected in a conventional manner by changing the manual fingering pattern, since all twelve tones per octave are available through the new player keyboard.

Transposition to different key signatures is accomplished through the selector keyboard by a logic system which causes certain of the tones ordinarily produced by digitals in a reset condition to be upshifted or downshifted by one half-tone in accordance with commands derived from a stored key signature program that maintains the same intertone interval pattern. Thus, one may play a major scale in any key signature through use of the same simple fingering sequence. The key signature is selected by actuation of a pushbutton on the selector keyboard arranged to effect between one and seven half-tone frequency shifts of the digitals in each octave on the keyboard in order to accommodate all key signatures.

These together with other objects and advantages which will become subsequently apparent reside in the details of construction and operation as more fully hereinafter described, reference being had to the accompanying drawings forming a part hereof, wherein like numerals refer to like parts throughout.

BRIEF DESCRIPTION OF DRAWING FIGURES

FIG. 5 is a transposition chart.

FIG. 10 is a schematic block diagram illustrating another embodiment of the present invention.

FIG. 11 is a circuit diagram illustrating details of the keyboard matrix depicted in FIG. 10.

DETAILED DESCRIPTION OF PREFERRED EMBODIMENTS

Figure 1:
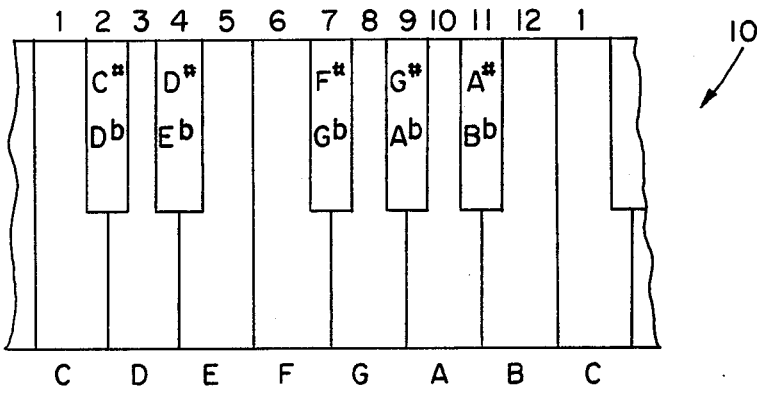
Fig 1 PRIOR ART
FIG. 1 is a top plan view of a portion of a standard keyboard.

Referring now to the drawings in detail, a portion of a standard keyboard is shown in FIG. 1 for comparison purposes, covering one octave of tones to be produced by the musical instrument with which it is associated. There are 12 keys shown numbered 1 through 12 corresponding to the 12 equitempered tones produced by actuation of the keys of one octave, these tones differing from each other in audio frequency or pitch by a constant factor equal to $12\sqrt{2}$ in an ascending order from left to right. The keys include the seven white digitals labeled C, D, E, F, G, A, B, C in FIG. 1 as naturals in accordance with accepted muscial notation. The five black digitals are labeled alternatively as a sharp (#) of a preceding natural or as a flat (♭) of a following natural. As is well known in the art, a major scale is played by actuation of seven digitals per octave to generate a sequence of tones that differ from each other in frequency or musical intertone interval in accordance with a fixed pattern of 2-2-1-2-2-2-1 halftones. Each half tone refers to the frequency spacing between the 12 equitempered tones of each octave. In the key signature of C, only the seven consecutive natural digitals are actuated to play the major scale. The same intertone interval pattern characterizes playing of major scales in all other key signatures. However, in the other key signatures, fingering sequences of white and black digitals differ. According to well known musical theory, there are 15 major scale key signatures including the key of C. It is the different tones in a scale, referred to as notes, that are denoted on the lines and the spaces between lines of a musical staff rather than the keys of the standard keyboard which are played in different sequences to produce the scale in different keys.

Figure 2:
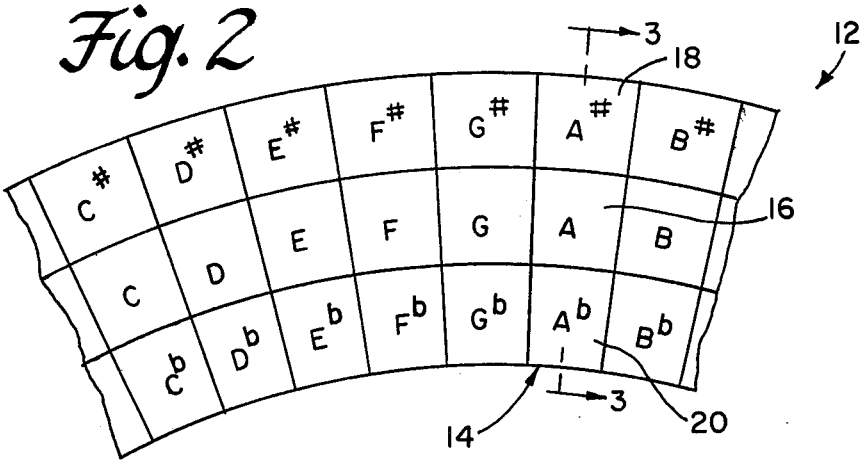
FIG. 2 is a top plan view of a portion of a keyboard constructed in accordance with one embodiment of the present invention.
Figure 3:
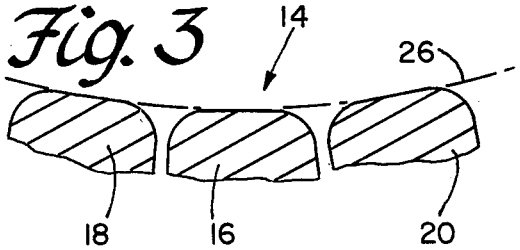
FIG. 3 is an enlarged partial section view taken through a plane indicated by section line 3—3 in FIG. 2.

FIG. 2 illustrates a portion of a new keyboard 12 arranged in accordance with the present invention which more closely corresponds to the arrangement of notes on the musical staff. The keyboard 12 includes a plurality of adjacent key groups 14 as shown in FIGS. 2 and 3, each group consisting of a primary digital 16 located intermediate secondary digitals 18 and 20. The primary digitals 16 form a horizontal bank of keys corresponding to only naturals (♮) or tones denoted on a musical staff as notes in the scale, designated by letters C, D, E, F, G, A and B covering one octave. The secondary digitals 18 form a bank of keys generally parallel to the bank of primary digitals, wherein each secondary digital 18 corresponds to a sharp (♯) of the natural or primary digital of its group 14, a half-step higher in tone. The secondary digitals 20 form a parallel bank of keys adapted to produce flats (♭) or tones one-half step lower than the associated primary or natural digitals. The naturals or primary digitals 16 extend horizontally from left to right on the keyboard 12 perpendicular to the vertical column of notes they correspond to on the musical staff, and are played in consecutive order to produce a major scale regardless of the key signature selected. The secondary digitals 18 and 20 are actuated to produce sharps or flats. No fingering transposition is required as in the case of the standard keyboard in order to change from one key signature to another. Instead, the key signature may be selected by actuation of an appropriate pushbutton on a selector keyboard generally referred to by reference numeral 24 in FIG. 4, the operation of which is to be explained hereinafter.

According to one possible embodiment as shown in FIG. 2, the parallel banks of keys are arranged in an arc for more convenient playing by the musician, while the top surfaces of the digitals in each group of three key sections may be tangent to a common arc 26 as shown in FIG. 3. While the flats producing digitals 20 are shown closer to the player than the sharps digitals 18 in FIG. 2, this locational relationship may be reversed if desired. Also, the banks of secondary digitals may be shifted horizontally in opposite directions relative to the intermediate bank of digitals 16 so as to align the key sections of each group 14 along diagonals rather than perpendicular to the line of banks as shown in FIG. 2. Still further, the top surfaces of each bank of digitals may be provided with different surface textures so as to distinguish between primary and secondary digitals by feel or touch. It will also be appreciated that all of the digitals of the keyboard 12 have a common finger contact surface whether it be in a single horizontal plane or along the common arc 26 shown in FIG. 3.

Figure 4:
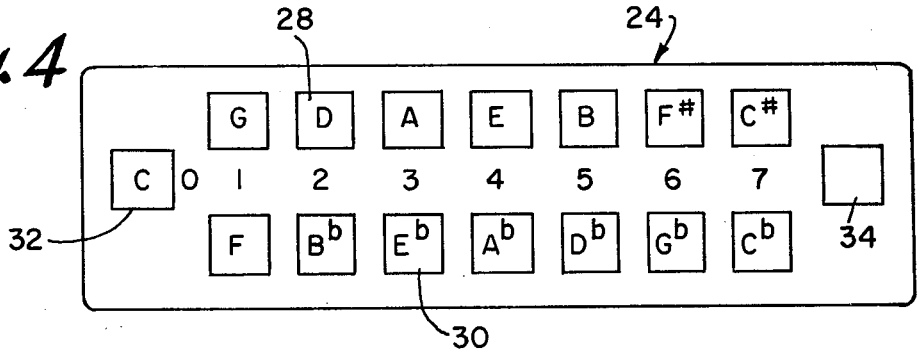
FIG. 4 is a top plan view of a selector keyboard associated with the present invention.

As hereinbefore indicated, transposition of the tones produced by actuation of the digitals 16, 18 and 20 in accordance with a desired key signature is effected through the selector keyboard 24. The selector keyboard as shown in FIG. 4 includes seven pairs of push buttons, consisting of an upper row of push buttons 28 and a lower row of push buttons 30 through which transposition from the key of C is effected. Operation of the player keyboard 12 is reset to the key of C by actuation of the push button 32. Other effects may be obtained by actuation of the pushbutton 34. When operating the keyboard 12 in the key of C, actuation of consecutive primary digitals beginning with natural C, for example, will produce the major scale on the associated musical instrument as denoted by the tonal number sequence shown on the uppermost row of the chart in FIG. 5 for one octave. The difference between the tonal numbers represents the intertone intervals aforementioned so that the tonal number sequence shown is characterized by the repeating intertone interval pattern of 2-2-1-2-2-2-1. This same intertone interval pattern characterizes all other sequences shown by the rows in the chart corresponding to the different key signatures. For example, the second row from the top in the chart of FIG. 5, corresponds to the key of G, and represents a transposition wherein a half-step upshift in tone for one of the digitals occurs upon actuation of the No. 1 upper push button 28 as denoted in FIG. 4. Upshift by a half-step for two of the digitals as represented in the chart of FIG. 5 is effected by actuation of the No. 2 upper pushbutton 28 for transposition to the key of D, and so on. Actuation of the lower push buttons 30 likewise causes downshift in tone for one to seven digitals as shown in the chart. Thus, transposition to 14 different key signatures is effected by either upshifting or downshifting tone frequency by a half-step from one to seven of the digitals in each octave. It will be noted from the columns in the chart of FIG. 5, that each digital undergoes a total shift of two half-steps in order to accommodate all of the key signature transpositions.

Figure 6:
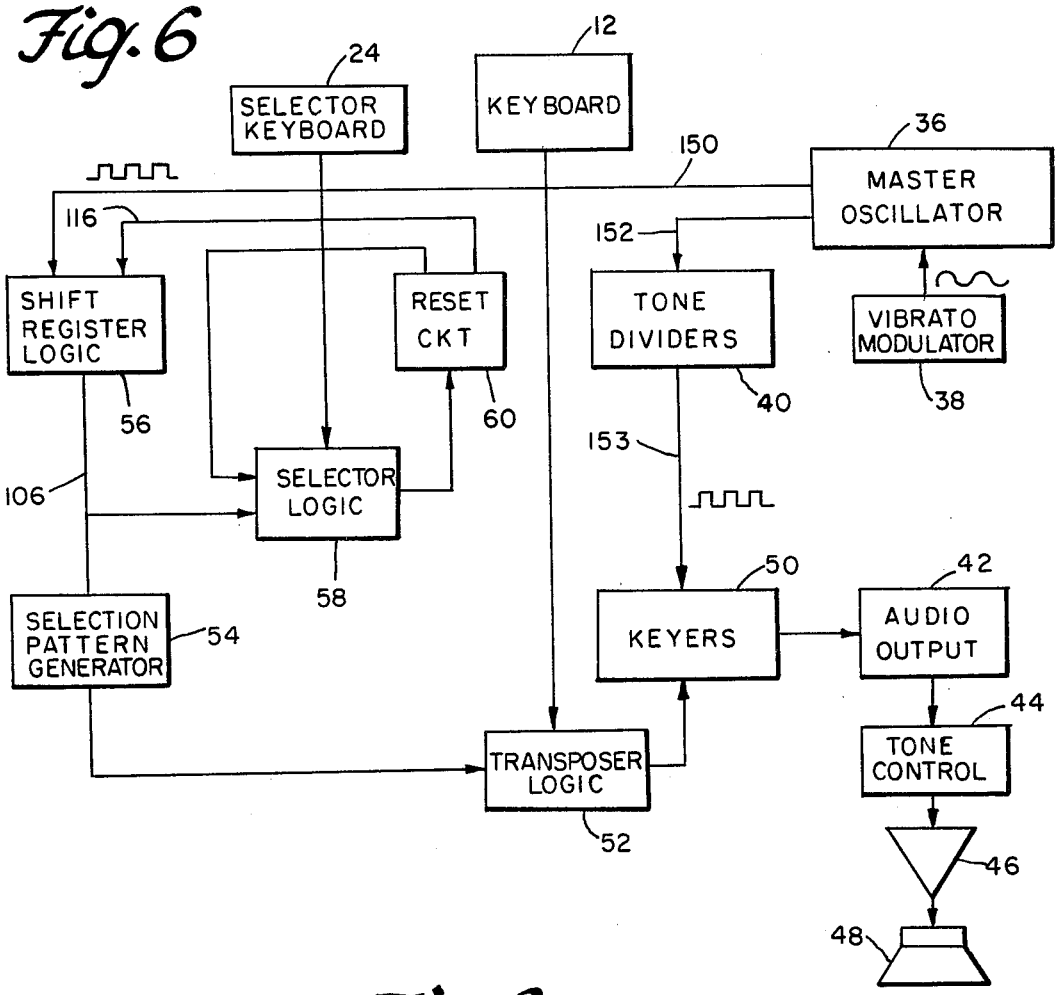
FIG. 6 is a schematic block diagram showing a control system associated with one embodiment of the present invention.

The present invention contemplates operation of a musical instrument through the keyboard 12, utilizing the selector keyboard 24 to effect transpositions to different key signatures by two half-step shifting of the tones produced by actuation of each of the digitals of the keyboard 12 in accordance with the patterns represented in the chart of FIG. 5. Toward this end, logic controls of any type capable of implementing the pattern described may be used including mechanical, pneumatic, hydraulic and electrical means and combinations thereof. Generation of tones by the musical instrument may also be effected mechanically, pneumatically, hydraulically or electronically. By way of example, FIG. 6 schematically illustrates a system embodying the player keyboard 12, the selector keyboard 24, the logic controls and tone generating facilities necessary to carry out the aforementioned principles of the present invention. As depicted in FIG. 6, the tones are electronically derived from a master oscillator 36 the output of which may be modulated by a vibrato modulator 38 and fed by line 152 to tone dividers 40 for generating the equitempered tones in accordance with apparatus and techniques well known in the art. The tones are also reproduced by well known means including an audio output circuit 42 from which the tones are fed through a tone control component 44 to amplifier 46 driving an output speaker 48. The tones fed to the audio output circuit 42 are selected by a keyer circuit component 50 to which keying signals are fed from a transposer logic component 52 under control of the player keyboard 12 in accordance with the present invention. The keying signals are derived from commands received from a selection pattern generator 54 to which signals are fed by line 106 from a shift register logic component 56 receiving clock pulses from oscillator 136 through line 150. The shift logic is controlled by the selector keyboard 24 through selector logic 58 and reset circuit 60 connected by reset line 116 to the shift logic 56.

Figure 7:
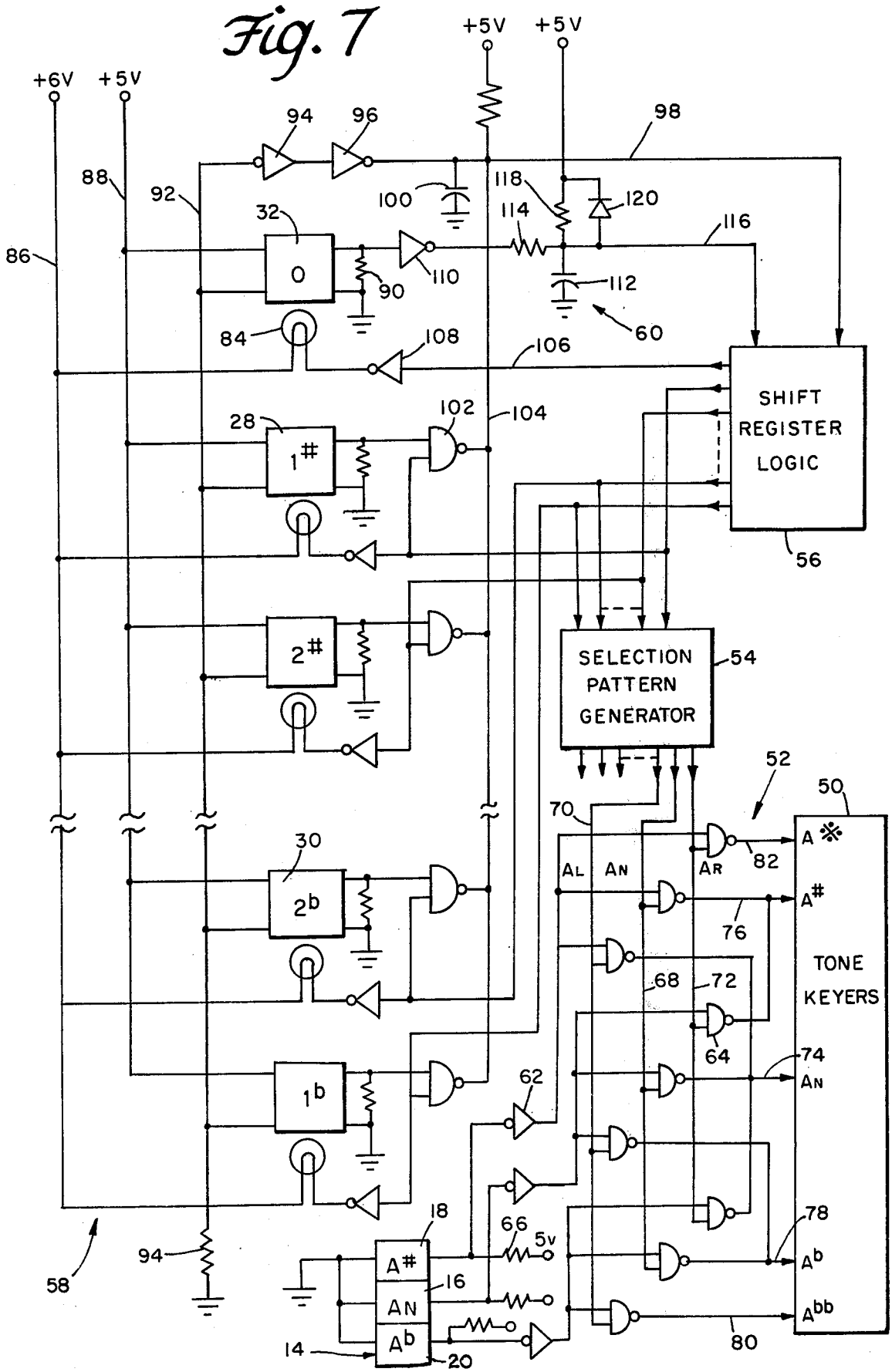
FIG. 7 is a circuit diagram showing details of the selector and transposer logics depicted in FIG. 6.

FIG. 7 illustrates a typical logic module in the transposer logic 52 associated with each of the key groups 14 by means of which keying signals are produced and fed to the tone keyers 50. Each of the three digitals of the group is connected by an inverter 62 to an array of nine NAND gates 64 as shown. A load resistor 66 connecting a 5 v source of voltage to each digital switch maintains it in a quiescent high state. When actuated, the output of the digital switch goes low and the signal is passed by an inverter 62 to the inputs of three NAND gates at a high logic level. When there is no transposition to be effected, the "natural" frequency level control line 68 is held to a high logic level while the other transposition control lines 70 and 72 are held at a low logic level. Accordingly, the three NAND gates having outputs respectively connected to the normal keying signal lines 74, 76 and 78 are enabled so that one of the latter lines will feed a keying signal to the keyer when a corresponding one of the digitals 16, 18 and 20 is actuated. These keying signals will produce tones that fall within the key of C signature as depicted in the top row of the chart of FIG. 5. In response to transposition to some other signature, either the "lower" line 70 or the "raise" line 72 is held at a high logic level while the other tranposition control lines are held low to enable either the two NAND gates 64 having outputs connected to keying lines 78 and 80 or the two NAND gates having outputs connected to keying lines 76 and 82. The NAND gate connected to keying line 74 is also enabled by both of the frequency shift lines 70 and 72 so that a total of three different NAND gates are enabled for each frequency shifted condition in each transposer module. Thus, the keying lines made effective are either shifted down or up depending on the transposition selected to lower or raise by a half step the tone produced by actuation of each of the digitals 16, 18 and 20. It will be appreciated that the same array of nine NAND gates forming the module shown in FIG. 7 is repeated for each group of digitals 14 having three transposition control lines 68, 70 and 72 associated therewith to which appropriate logic level voltages are applied from the selection pattern generator 54. Thus, the NAND gate array shown in FIG. 7 is uniquely suitable for the purposes of the present invention by providing a natural keying signal line 74 connected to the outputs of three NAND gates, sharp or flat signal lines 76 and 78 respectively connected to the outputs of two NAND gates and double sharp or flat signal lines 80 and 82 respectively connected to the output of a single NAND gate.

With continued reference to FIG. 7, a portion of the selector logic 58 is depicted showing illumination of each of the push buttons 28, 30 and 32 by a lamp 84 connected to a common 6 volt power line 86. A solid-state switch associated with each push button has a first positive terminal connected to a common 5 volt power line 88 and a negative terminal connected to ground. A first output terminal is normally maintained low by resistor 90. A second output terminal of each selector push button switch is connected to a common signal line 92 which is normally maintained low by grounded resistor 94. When the push button switch is actuated both outputs are raised to the high logic level including the common line 92 connected to shift-enable line 98 by the series connected inverter 94 and driver 96 after a delay predetermined by charging of grounded capacitor 100. The first output of each of the selector switches associated with the push buttons 28 and 30 are connected through NAND gates 102 and a common stop line 104 to the shift enable line 98 for stopping operation of the shift register logic 56. As a result of shift logic operation, one of the output lines 106 thereof corresponding to the actuated push button switch 28 or 30, is raised to a high level causing the output of driver 108 connecting it to a lamp 84 to go low and illuminate the push button to indicate the key signature under which the player keyboard 12 is operative.

To reset operation of the keyboard 12 to the key of C, the selector push button 32 is actuated causing its first output to produce a low logic level at the output of driver 110. The capacitor 112 in the reset circuit 60 is thereby discharged through resistor 114 connecting the driver 110 to the shift register logic 56 through reset signal line 116. The capacitor 112 normally maintains the reset line 116 at a high logic level through charging resistor 118 and diode 120 connecting it in parallel to a 5 volt power source.

Figure 8:
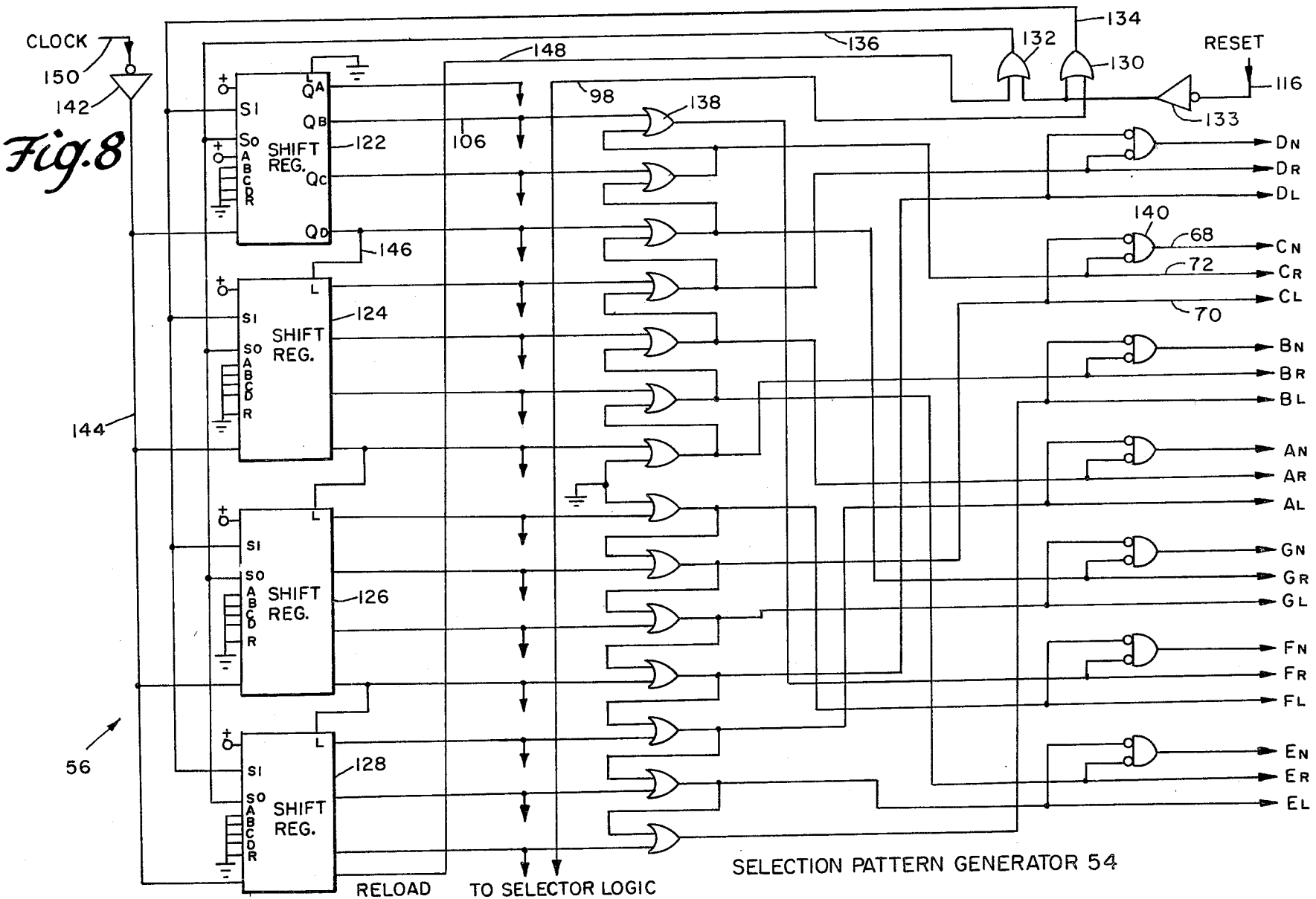
FIG. 8 is a circuit diagram showing details of the shift register and selection pattern generator logics depicted in FIG. 6.

The shift register logic 56 as shown in FIG. 8 includes four, 4-bit universal registers 122, 124, 126 and 128 adapted for operation of a four octave player keyboard 12, to store commands from the 15 push buttons 28, 30 and 32 associated with the selector keyboard 24 as aforementioned. These registers are arranged to scan the pushbutton switches and stop shifting operation when reaching the actuated pushbutton causing illumination of its lamp 84, by supply of a signal thereto through one of 15 lines 106, 14 of which are also connected to the selection pattern generator 54. When power is initially turned on, a high logic level state is applied from the reset circuit 60 to the reset line 116 after a predetermined delay to cause the inputs of OR gates 130 and 132 to go low through inverter 133. Low logic levels are thereby established at the outputs of the OR gates in the quiescent state to direct the registers to hold their contents through hold lines 134 and 136. All of the four ABCD inputs to the registers are grounded at a low level except for the A input of register 122 to which a high 3 volt level source is connected to produce a high level output at the first of its four output terminals to which the first of the output lines 106 is connected, while in the reset condition. The lamp 84 for pushbutton 32 will therefore be illuminated to indicate the reset condition. The other outputs of the registers, connected to the selection pattern generator 54 by lines 106 are held low in the reset condition so that low logic levels are applied thereby to the inputs of 14 OR gates 138 in the pattern generator 54. This results in low logic levels in the transposition control lines 70 and 72 connected to each of the logic modules of the transposer logic 52 aforementioned in connection with FIG. 7. With low logic levels in all control lines 70 and 72 connected to the outputs of the OR gates 138, high logic levels are held at the outputs of the seven AND gates 140 of the pattern generator as shown in FIG. 8, to which the control lines 68 are connected for activating the keying signal lines 74, 76 and 78 of the transposer logic 52 as aforementioned.

When a push button 28 or 30 is actuated to produce a delayed enabling signal in line 98 connected to one input of OR gate 130, the logic level in line 134 goes high. Line 134 being connected to one of the mode control terminals of each register 122, 124, 136 and 128 causes them to shift in one direction in response to clock pulses received from the master oscillator 36 through inverter 142 and clock signal line 144 connected to the clock terminals of each of the registers. The initial high logic level at the first output of register 122 shifts to the next output upon receipt of the next clock pulse. This shifting continues and is transferred from one register to the next through serial interconnections 146 between the registers. When one of the outputs of the registers corresponds to the actuated push button, the associated line 106 applies the high to the input of an associated NAND gate 102 as shown in FIG. 7 to switch line 104 to a low state and cause line 98 through OR gate 130 to lower line 134 to the low level and stop the shift operation of the registers. When the actuated push button is subsequently released, NAND gate 102 is deactivated and capacitor 100 begins to charge toward a high logic level. However, at the same time line 92 connected to the other output terminal of the released pushbutton switch goes low discharging capacitor 100 through inverting driver 96 to maintain a low logic level on lines 104 and 98. The registers therefore remain in the holding state with one output line 106 from the shifted registers at a high logic level. When another pushbutton 28 or 30 is the actuated, the same operational sequence ensues to continue the shift operation of the registers from the last output position at which it was stopped. When the high logic level is shifted to the last output of register 128, it is applied through reload line 148 to one of the inputs of OR gate 132. A high logic level is thereby applied by OR gate 132 through line 136 to the other mode terminals of the registers for loading of the registers to resume shifting beginning again with the first register 122 until the last actuated pushbutton is reached.

Figure 9:
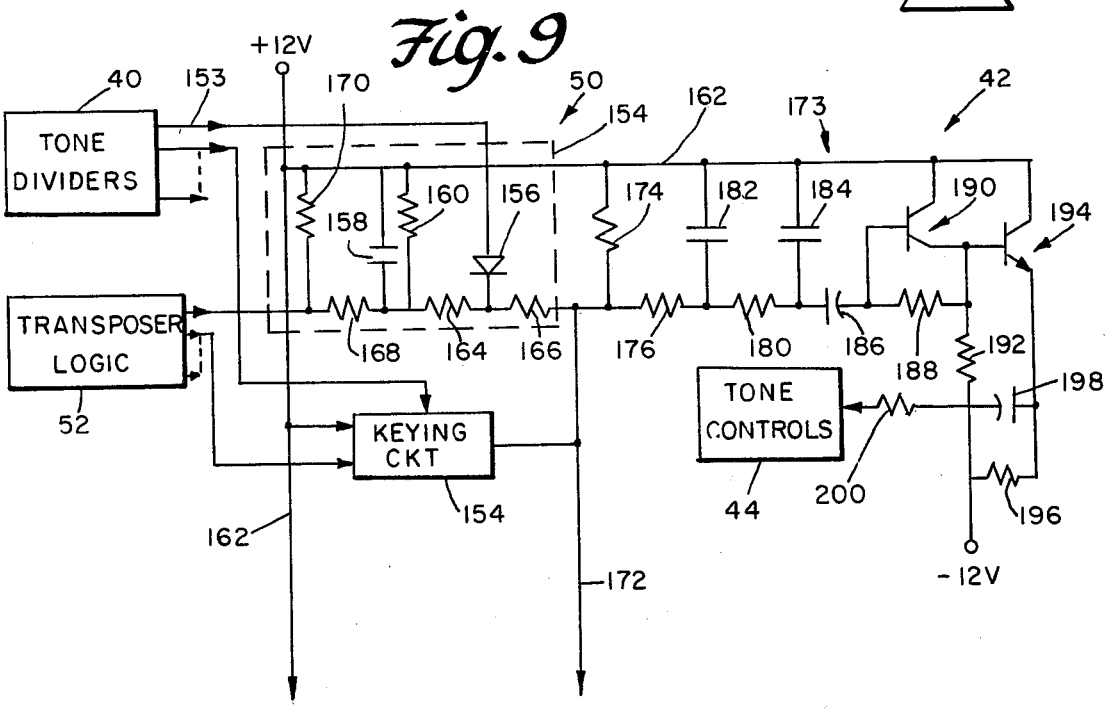
FIG. 9 is a circuit diagram showing details of the keyers and audio output circuits depicted in FIG. 6.

Referring once again to FIG. 6, the single master oscillator 36, which is the source for all tones, has two outputs of different amplitude but of the same frequency respectively connected by line 150 to the shift register logic 56 for supply of clock pulses and line 152 for supply of a square wave to drive trigger inputs of the tone dividers 40 and thereby establish the half tone relationships and the various octaves associated with the player keyboard 12. The square wave outputs 153 of the tone dividers are fed to the keyers 50 for gating in such a manner as to impose "attack" and "decay" time on the tones as well as to suppress harmonics. Thus, each of the outputs in lines 153 as shown in FIG. 9 is fed to one of 12 repeated keying circuits 154 for each octave through a diode 156 connected to the junction of resistors 164 and 168. Each keying circuit has a capacitor 158 connected in parallel with resistor 160 to a 12 volt power line 162, the capacitor normally being held discharged by the transposer logic 52 in an inactive state. Keying signals are conducted through a resistor 168 in each keying circuit to the capacitor 158 causing it to slowly charge when a low logic level is established at the output of the transposer logic 52 as a result of the actuation of a corresponding digital of the player keyboard 12. The voltage across capacitor 158 increases at a predetermined charging rate to a stabilized level corresponding to a maximum current conducted through resistor 166. Upon release of the keyboard digital, the capacitor 158 discharges through resistors 168, 170 and 160 at a slower rate than its charging rate to provide for a larger decay time as compared to the attack time when passing a tone to a common output line 172, through resistor 166. All twelve tones of the octave are applied by line 172 to a low pass filter formed by resistors 174, 176 and 180, and capacitors 182 and 184 in one of the circuits 173 for each of the octaves handled by the audio output section 42. Capacitor 186 and resistor 188 form a high pass filter for blocking DC. A transistor 190 having its emitter connected to the 12 volt power line 162 and its base connected to the junction between capacitor 186 and resistor 188, operates as a voltage amplifier to develop an output across resistor 192 connected to the collector of the transistor. A transistor 194 having its input base connected to the output collector of transistor 190, acts as an emitter follower buffer yielding a low impedance output across resistor 196. Capacitor 198 and resistor 200 connected in series to the output emitter of transistor 194 supply a composite audio signal to the tone controls 44.

FIG. 10 illustrates another possible method of implementing the principles of the present invention in a less costly manner, particularly for an electronic tone generating type of musical instrument having a player keyboard with more than seven octaves. A keyboard matrix 202 connected through input ports 204 to a common bus 206 is scanned through output ports 208 by a microprocessor unit 210 to supply commands through output ports 212 to the tone keyers 214 through which tones from generator 216 are passed to the output amplifier 218 driving the speaker 220. Key signature selections are made through a selector keyboard 222 connected by input port 224 to the common bus 206. The program controlling operation of the microprocessor 210 is stored in a read only memory 226 while a read/write memory 228 stores intermediate results of computations and stores the current transposition pattern selected through keyboard 222.

By utilizing the system depicted in FIG. 10, the keyboard gate logic 52 hereinbefore described may be replaced by a diode matrix for each octave of the keyboard 202, as shown in FIG. 11. The matrix includes seven output lines 230 interconnected with three transposition control lines 232, 234 and 236 through digital actuated switches 238 in series with diodes 240. The output lines 230 are connected to the common bus 206 for sampling by the microprocessor while the control lines 232,234 and 236 are continuously and rapidly selected one-at-a-time under program control for effecting the same transpositions as hereinbefore described in the reference to FIGS. 2 and 5.

The foregoing is considered illustrative only of the principles of the invention. Further, since numerous modifications and changes will readily occur to those skilled in the art, it is not desired to limit the invention to the exact construction, arrangement and operation shown and described, and accordingly, all suitable modifications and equivalents may be resorted to, falling within the scope of the invention.

What is claimed is:

1. For use with a musical instrument having means for generating equitempered tones, a keyboard having substantially parallel banks of primary and secondary digitals, transposing means connecting the keyboard to the generating means and responsive to actuation of consecutive digitals for producing the tones in a predetermined repeating intertone interval pattern, and means responsive to actuation of the secondary digital corresponding to each of the primary digitals for producing the tones that are respectively one-half tone intervals and or below the tones produced by actuation of the primary digitals, each of the primary digitals being aligned with the secondary digitals corresponding therewith to form a group of three keys.

2. The combination of claim 1 wherein the primary digital in each of said groups of keys is located intermediate two of the secondary digitals.

3. The combination of claim 2 wherein the digitals each of the groups have common finger contact surfaces.

4. The combination of claim 1 wherein each of the digitals of said groups have common finger contact surfaces.

5. The apparatus as defined in claim 1 wherein said transposing means includes logic means connected to each of said digitals for producing three of the tones differeing from each other by half tone intervals, transposition control means connected to the logic means for selection of one of said three tones in response to commands, means for storing the commands fed to the logic means through the transposition control means, and selector means connected to the storing means for generating the commands fed to the transposition means in accordance with a selected key signature.

6. The combination of claim 5 wherein said logic means includes a NAND gate module.

7. For use with a keyboard having a plurality of keys and means for generating tones differing from each other in frequency by a constant interval factor, transposing means connecting the keyboard to the tone generating means for producing three of the tones of adjacent frequencies in response to actuation of each one of the keys, storing means connected to the transposing means for selection of one of the three tones produced in response to actuation of each of the keys in accordance with one of a plurality of key signatures, and selector means connected to the storing means for selection of one of the key signatures, said keys including adjacent primary digitals producing tones that differ from each other in accordance with a repeating intertone interval pattern, and group of two secondary digitals actuated to produce the other of the tones of equal frequency steps above and below the frequency of the tones produced by actuation of the primary digitals.

8. The combination of claim 7 wherein all of the digitals have a common finger contact surface.

9. The apparatus as defined in claim 7 wherein said transposing means includes modules respectively connected to said keys producing the three tones of adjacent frequency, each of said modules comprising nine logic gates connected to the primary and secondary digitals of said key group.

10. For use with a source of signals of different frequencies, a keyboard including a group of keys having three digitals by means of which a keying signal from said source is selected, and control means for effecting a shift in frequency level of the selected keying signal, a transposition logic module connected to said group of keys including five output signal lines through which five frequency spaced keying signals are transmitted from said source, three logic gates respectively connecting the three digitals to a common one of the output signal lines transmitting said selected keying signal, two pairs of logic gates respectively connecting two of the three digitals to two of the other of the output signal lines transmitting frequency shifted keying signals at single frequency steps above and below said selected keying signal, one pair of logic gates respectively connecting said two of the three digitals to another two of the output signal lines transmitting frequency shifted keying signals at two frequency steps above and below said selected keying signal, and gate enabling means connecting the control means to said logic gates for establishing signal paths between said digitals and three of the output signal lines.

* * * * *

UNITED STATES PATENT AND TRADEMARK OFFICE

CERTIFICATE OF CORRECTION

PATENT NO. : 4,198,890

DATED : April 22, 1980

INVENTOR(S) : CARMAN J. MASSEY and PAUL N. ALITO

It is certified that error appears in the above-identified patent and that said Letters Patent are hereby corrected as shown below:

In the specification:

Column 2, line 62, change "$\sqrt{2}$" to -- $\sqrt{2}$ --.

Column 9, line 3, pluralize "digital".

Column 9, line 6, change "and" to -- above --.

Column 10, line 5, pluralize "group".

Signed and Sealed this

*Twenty-fourth* Day of *June 1980*

[SEAL]

*Attest:*

SIDNEY A. DIAMOND

*Attesting Officer*

*Commissioner of Patents and Trademarks*